US008477160B2

(12) United States Patent
Furuta

(10) Patent No.: US 8,477,160 B2
(45) Date of Patent: Jul. 2, 2013

(54) IMAGE DISPLAY CONTROL DEVICE, IMAGE DISPLAY CONTROL PROGRAM, AND IMAGE DISPLAY CONTROL METHOD

(75) Inventor: Yasuhiro Furuta, Kitakyushu (JP)

(73) Assignee: Seiko Epson Corporation, Tokyo (JP)

( * ) Notice: Subject to any disclaimer, the term of this patent is extended or adjusted under 35 U.S.C. 154(b) by 506 days.

(21) Appl. No.: 12/508,491

(22) Filed: Jul. 23, 2009

(65) Prior Publication Data

US 2010/0020115 A1 Jan. 28, 2010

(30) Foreign Application Priority Data

Jul. 24, 2008 (JP) ..... 2008-190741

(51) Int. Cl.
*G09G 5/02* (2006.01)

(52) U.S. Cl.
USPC ..... 345/694

(58) Field of Classification Search
USPC ..... 345/55, 76, 82, 83, 87, 88, 694, 695, 345/696; 250/552, 553; 313/500
See application file for complete search history.

(56) References Cited

U.S. PATENT DOCUMENTS

| | | | | |
|---|---|---|---|---|
| 5,006,840 | A * | 4/1991 | Hamada et al. | 345/88 |
| 5,192,945 | A * | 3/1993 | Kusada | 345/88 |
| 5,485,293 | A * | 1/1996 | Robinder | 345/88 |
| 5,767,837 | A * | 6/1998 | Hara | 345/694 |
| 6,008,868 | A * | 12/1999 | Silverbrook | 348/790 |
| 6,243,055 | B1 * | 6/2001 | Fergason | 345/32 |
| 6,326,981 | B1 * | 12/2001 | Mori et al. | 345/695 |
| 6,327,008 | B1 * | 12/2001 | Fujiyoshi | 349/106 |
| 6,486,923 | B1 * | 11/2002 | Maeshima et al. | 348/649 |
| 7,471,274 | B2 * | 12/2008 | Kim | 345/88 |
| 7,522,132 | B2 * | 4/2009 | Hamamoto et al. | 345/75.2 |
| 7,570,255 | B2 | 8/2009 | Tanaka | |
| 7,595,782 | B2 * | 9/2009 | Herrmann | 345/98 |
| 7,737,931 | B2 * | 6/2010 | Koyama et al. | 345/87 |
| 7,787,001 | B2 | 8/2010 | Namie et al. | |
| 7,880,698 | B2 * | 2/2011 | Park et al. | 345/82 |
| 8,026,669 | B2 * | 9/2011 | Kawasaki et al. | 315/169.3 |
| 8,063,852 | B2 * | 11/2011 | Kwak et al. | 345/76 |
| 2002/0070909 | A1 * | 6/2002 | Asano et al. | 345/76 |
| 2002/0140831 | A1 * | 10/2002 | Hayashi | 348/272 |
| 2002/0140833 | A1 * | 10/2002 | Hirai | 348/280 |
| 2004/0239837 | A1 * | 12/2004 | Hong et al. | 349/106 |
| 2006/0061531 | A1 * | 3/2006 | Park et al. | 345/88 |
| 2007/0229422 | A1 * | 10/2007 | Hung | 345/88 |
| 2008/0001525 | A1 * | 1/2008 | Chao et al. | 313/500 |

FOREIGN PATENT DOCUMENTS

| | | |
|---|---|---|
| JP | 2003-241718 A | 8/2003 |
| JP | 2006-171730 A | 6/2006 |
| JP | 2006-195415 A | 7/2006 |
| JP | 2006-259403 A | 9/2006 |

* cited by examiner

*Primary Examiner* — Tom Sheng
(74) *Attorney, Agent, or Firm* — Kilpatrick Townsend & Stockton LLP

(57) ABSTRACT

An image display control device for controlling display of an image to a display device having a plurality of unit display elements in which three unit display elements corresponding to signals of three primary colors, respectively, are arranged in a delta form, includes an image data input unit which inputs image data, and an image drawing unit which draws an image on the basis of the input image data such that two of the three unit display elements are in a pair and constitute one pixel of the image and the remaining one unit display element constitutes one pixel of the image.

4 Claims, 8 Drawing Sheets

| | | | | | | | | | | | | | | |
|---|---|---|---|---|---|---|---|---|---|---|---|---|---|---|
| R00 | G00 | B00 | R01 | G01 | B01 | R02 | G02 | B02 | R03 | G03 | B03 | R04 | G04 | B04 |
| R10 | G10 | B10 | R11 | G11 | B11 | R12 | G12 | B12 | R13 | G13 | B13 | R14 | G14 | B14 |
| R20 | G20 | B20 | R21 | G21 | B21 | R22 | G22 | B22 | R23 | G23 | B23 | R24 | G24 | B24 |
| R30 | G30 | B30 | R31 | G31 | B31 | R32 | G32 | B32 | R33 | G33 | B33 | R34 | G34 | B34 |

FIG. 4

| | | | | | | | | | | | | | | |
|---|---|---|---|---|---|---|---|---|---|---|---|---|---|---|
| R00 | G00 | B00 | R01 | G01 | B01 | R02 | G02 | B02 | R03 | G03 | B03 | R04 | G04 | B04 |
| R10 | G10 | B10 | R11 | G11 | B11 | R12 | G12 | B12 | R13 | G13 | B13 | R14 | G14 | B14 |
| R20 | G20 | B20 | R21 | G21 | B21 | R22 | G22 | B22 | R23 | G23 | B23 | R24 | G24 | B24 |
| R30 | G30 | B30 | R31 | G31 | B31 | R32 | G32 | B32 | R33 | G33 | B33 | R34 | G34 | B34 |

FILTER PROCESSING ⇩

| | | | | | | | | | | | |
|---|---|---|---|---|---|---|---|---|---|---|---|
| (R00 + R01) /2 | (G00 + G01) /2 | (B00 + B01) /2 | (R01 + R02) /2 | (G01 + G02) /2 | (B01 + B02) /2 | (R02 + R03) /2 | (G02 + G03) /2 | (B02 + B03) /2 | (R03 + R04) /2 | (G03 + G04) /2 | (B03 + B04) /2 |
| (R10 + R11) /2 | (G10 + G11) /2 | (B10 + B11) /2 | (R11 + R12) /2 | (G11 + G12) /2 | (B11 + B12) /2 | (R12 + R13) /2 | (G12 + G13) /2 | (B12 + B13) /2 | (R13 + R14) /2 | (G13 + G14) /2 | (B13 + B14) /2 |
| (R20 + R21) /2 | (G20 + G21) /2 | (B20 + B21) /2 | (R21 + R22) /2 | (G21 + G22) /2 | (B21 + B22) /2 | (R22 + R23) /2 | (G22 + G23) /2 | (B22 + B23) /2 | (R23 + R24) /2 | (G23 + G24) /2 | (B23 + B24) /2 |
| (R30 + R31) /2 | (G30 + G31) /2 | (B30 + B31) /2 | (R31 + R32) /2 | (G31 + G32) /2 | (B31 + B32) /2 | (R32 + R33) /2 | (G32 + G33) /2 | (B32 + B33) /2 | (R33 + R34) /2 | (G33 + G34) /2 | (B33 + B34) /2 |

IMAGE DISPLAY CONTROL DEVICE, IMAGE DISPLAY CONTROL PROGRAM, AND IMAGE DISPLAY CONTROL METHOD

This application claims priority to Japanese Patent Application No. 2008-190741, filed Jul. 24, 2008, the entirety of which is incorporated by reference herein.

BACKGROUND

1. Technical Field

The present invention relates to an image display control device, an image display control program, and an image display control method, and in particular to an image display control device for controlling the display of an image to a display device having a plurality of unit display elements in which three unit display elements corresponding to signals of three primary colors are arranged in a delta form, an image display control program for causing a computer to function as the image display control device, and an image display control method.

2. Related Art

From the past, as such a kind of image display control devices, JP-A-2003-241718 disclosed an image display control device which displays an image on a display device (a plasma display panel or a liquid crystal display) in which three dots corresponding to RGB signals are arranged in a delta form. In this device, the image is displayed by forming one pixel of a screen by three dots (RGB dots) which have delta arrangement.

However, the delta-arrangement display device generally has a tendency in which the number of displayable RGB dots arranged in the lengthwise direction is smaller than that in a stripe type display device in which dots are arranged in a lateral direction. With the structure in which one pixel of an image is composed of three dots (RGB dots), visual resolution and display quality are lowered. On the other hand, in a structure in which one pixel is composed of any one of three dots (RGB dots), any signals other than signals corresponding to respective dots among RGB signals are not used. Accordingly, such a structure is disadvantageous in that it is needed to input an image which is about three times larger than the to-be-displayed image on a screen, which leads to the increase in the memory use and the load in the processing of display data. Further, while the structure of the delta arrangement is disadvantageous in that filtering processing for suppressing occurrence of a false color is needed, the case of forming one pixel with only any one of three dots (RGB dots) is disadvantageous in that the filter operation processing becomes complicated and the processing load increases.

SUMMARY

An advantage of some aspects of the invention is to provide an image display control device, an image display control program, and an image display control method which can improve the display quality of a display device having a delta arrangement structure.

The above-mentioned image display control device, image display control program, and image display control method are attained by the following means.

According to one aspect of the invention, there is provided an image display control device for controlling display of an image to a display device having a plurality of unit display elements in which three unit display elements corresponding to signals of three primary colors, respectively, are arranged in a delta form, including an image data input unit which inputs image data, and an image drawing unit which draws an image on the basis of the input image data such that two of the three unit display elements are in a pair to display one pixel of the image and the remaining one unit display element displays another pixel of the image.

In the image display control device, the image data is input and the image is drawn on the basis of the input image data in a manner such that two unit display elements among three unit display elements corresponding to signals of three primary colors and arranged in a delta form are in a pair so that two unit display elements display one pixel of the image and the remaining one unit display element displays another pixel of the image. With such a structure, it is possible to display an image with better display quality in comparison with the structure in which three unit display elements are set as one set so that one pixel of the image is displayed by the three unit display elements. Further, with such a structure, it is possible to decrease the size of image data which must be input and reduce an operation amount in comparison with the structure in which each of three unit display elements displays one pixel of the image.

In the image display control device, it is preferable that the two of three unit display elements are red (R) and blue (B) unit display elements and the remaining one unit display element is a green (G) unit display element. This is because green is higher in sensitivity of a human eye (spectral sensitivity) than red and blue. With this structure, it is possible to further improve the display quality.

In the image display control device, it is preferable that the image drawing unit is a unit for drawing the image by setting the pair of unit display elements such that the pair of unit display elements and the remaining one unit display element are arranged in a lattice form. With this structure, it is possible to simplify the processing of the input image data. In this image display control device, the image drawing unit may be a unit for drawing an image with processed image data obtained by subjecting the input image data to filter processing. With this structure, it is possible to simplify operation of the filter processing.

According to another aspect of the invention, a computer serves as the above-mentioned image display control device.

This program may be recorded on a computer readable recording medium, for example, hard disk, read only memory (ROM), floppy disk (FD), compact disk (CD), and digital versatile disc (DVD), transmitted to a computer from another computer connected by a transmission medium, for example, a communication network, such as Internet and Local Area Network (LAN), or transferred and received in other forms. If this program is executed by a single computer or by a plurality of computers in a manner such that steps of the program are executed by the plurality of computers, respectively, in the divided form, the computer (or the computers) functions (or function) as the image display control device, so the same advantage as in the control device can be attained.

According to a further aspect of the invention, there is provided an image display control method of controlling display of an image to a display device in which three unit display elements corresponding to signals of three primary colors are arranged in a delta form, in which the image display control method includes (a) inputting image data and (b) drawing an image on the basis of the input image data such that two of the three unit display elements are in a pair and display one pixel of the image and remaining one unit display element displays one pixel of the image.

According to the image display control method of the invention, the image data is input and the image is drawn on the basis of the input image data, two of three unit display elements corresponding to signals of three primary colors which are arranged in a delta form are in one pair so that one pixel of the image is displayed by the two unit display elements which are on the pair and another pixel of the image is displayed by the remaining one unit display element. With this structure, it is possible to further improves the display quality in comparison with the structure in which three unit display elements are in one set so that one pixel of the image is displayed by the three unit display elements in the set. Further, it is possible to decrease the size of the input image data and reduce an operation amount in comparison with the structure in which each of three unit display elements displays one pixel of the image.

BRIEF DESCRIPTION OF THE DRAWINGS

The invention will be described with reference to the accompanying drawings, wherein like numbers reference like elements.

FIG. 4 is an explanatory view illustrating image data before filter processing and after filter processing, respectively.

DESCRIPTION OF EXEMPLARY EMBODIMENTS

Figure 1:
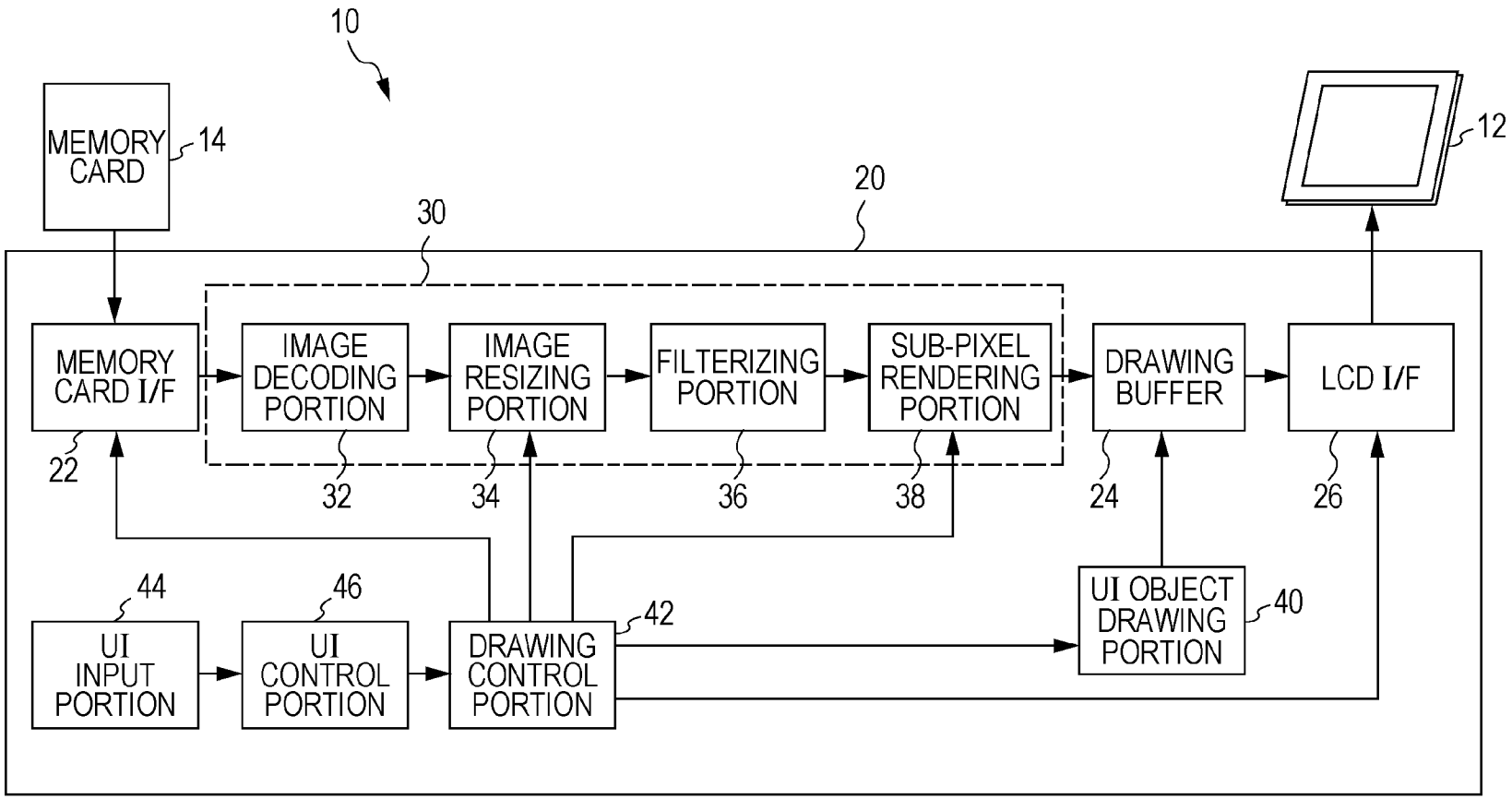
FIG. 1 is a configuration diagram illustrating a structure of a display device 10 incorporated in an image display control device 20 which is one embodiment of the invention.
Figures 2, 3:
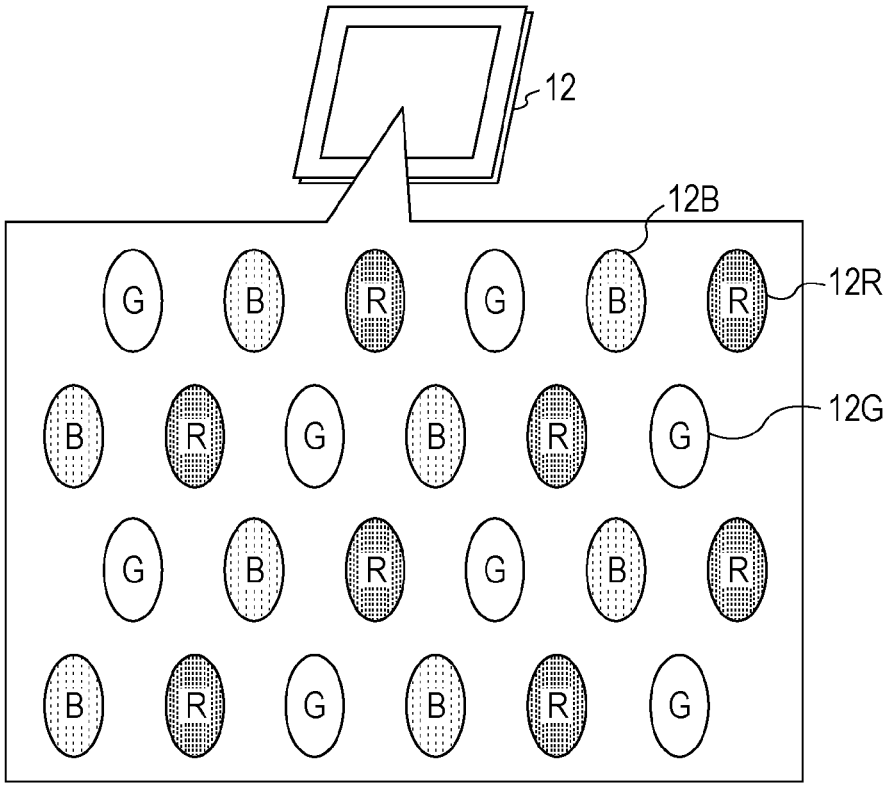
FIG. 2 is an explanatory view for explaining arrangement of dots of a liquid crystal display 12.
FIG. 3 is an image data obtained after resizing.

Next, the best embodiment for practicing the invention will be described with reference to the accompanying drawings. FIG. 1 is a configuration view illustrating an outline of a structure of a display device 10 incorporated into an image display control device 20 which is one embodiment of the invention. FIG. 2 is an explanatory view for explaining arrangement of dots 12R, 12G, and 12B of RGB colors of a liquid crystal display 12.

As shown, the image display control device 20 of this embodiment is structured to control display an image to a liquid crystal display (LCD) 12 having a plurality of dots formed such that three dots ("dot" is also called "sub-pixel") corresponding to RGB signals of three primary colors are arranged in a delta form. The image display control device 20 includes a memory card interface (I/F) 22 which is connected to a memory card 14 for taking in an image from the memory card 14, an image drawing portion 30 which reads a digital image (hereinafter, referred to as image) from the memory card 14 via the memory card I/F 22 and draws an image to an image buffer 24, a UI object drawing portion 40 which draws objects, such as characters and symbols, to be displayed on a screen according to instructions from a user, to a drawing buffer 24, an LCD interface (I/F) 26 performing transmission of the image drawn in the drawing buffer 24 to the LCD 10, a drawing control portion 42 for controlling the memory card I/F 22, the image drawing portion 30, the LCD I/F 26, and the UI object drawing portion 40, a UI input portion 44 which receives manipulation signals from manipulation buttons manipulated by the user, and a UI control portion 46 which receives the manipulation signals from the UI input portion 44 and outputs a control signal to the drawing control portion 42.

The image drawing portion 30 includes an image decode portion 32 which decodes an image encoded into various kinds of formats (for example, JPEG, GIF, and etc.) input from the memory card I/F 22, an image resizing portion 34 which changes a size of the image decoded by the image decoding portion 32, a filtering portion 36 for subjecting the resized image to filter processing, and a sub-pixel rendering portion 38 which draws the filter-processed image to the drawing buffer 24.

The image resizing portion 34 is structured to resize the image input from the image decoding portion 34 on the basis of the size of the image specified by the image control portion 46 and output the resized image to the filtering portion 36. In this embodiment, the image resizing portion 34 resizes the image decoded by the image decoding portion 32 by incrementing one pixel to the horizontal (lateral) size specified by the drawing control portion 46 and increasing twice the vertical (longitudinal) size specified by the image control portion 46. That is, when the specified size is 640×480 VGA, it is resized to 641×960. FIG. 3 shows the image data after resizing. In FIG. 3, for convenience sake for explanation, when the size specified by the drawing control portion 46 is 4 pixels in lateral and 2 pixels in longitudinal (i.e. 4×2 size), it is resized to 5 pixels in lateral and 4 pixels in longitudinal (i.e. 5×4 size).

The filtering portion 36 is structured to perform filter processing with respect to the image input from the image resizing portion 34 and output the filter-processed image to the sub-pixel rendering portion 38. In this embodiment, the filter processing is performed by taking the average value of luminance values of two pixels adjacent to each other in the lateral direction according to the following equations 1 to 3. Here, "Pr(x, y)" in equations 1 to 3 shows a luminance value of red (R) at a coordinate (x, y) of the input image input from the image resizing portion 34, "Pg(x, y)" shows a luminance value of green (G) at the coordinate (x, y) of the input image input from the image resizing portion 34, and "Pb(x, y)" shows a luminance value of blue (B) at the coordinate (x, y) of the input image input from the image resizing portion 34. Further, "Qr(x, y)" shows a luminance value of red (R) at the coordinate (x, y) of the filter processed image, "Qg(x, y)" shows a luminance value of green (G) at the coordinate (x, y) of the filter processed image, and "Qb(x, y)" shows a luminance value of blue (B) at the coordinate (x, y) of the filter processed image. FIG. 4 is an explanatory view for showing image data before filter processing and after filter processing. In FIG. 4, "R00 to R33" show luminance values of red (R), "G00 to G33" show luminance values of green (G), and "B00 to B33" show luminance values of blue (B). With such filter processing, image data which is smaller than the image data input from the image resizing portion 34 by one pixel in the lateral direction is produced.

$$Qr(x,y) \leftarrow [Pr(x,y)+Pr(x+1,y)]/2 \quad 1;$$

$$Qg(x,y) \leftarrow [Pg(x,y)+Pg(x+1,y)]/2 \quad 2; \text{ and}$$

$$Qb(x,y) \leftarrow [Pb(x,y)+Pb(x+1,y)]/2 \quad 3$$

The sub-pixel rendering portion 38 is structured to draw the filter processed image input from the filtering portion 36 on the drawing buffer 24 and is controlled by the drawing control portion 42. Operation of the sub-pixel rendering portion 38 will be described later in detail.

The drawing control portion 42 is made to be able to exchange a control signal among the memory card I/F 22, the image resizing portion 34, the sub-pixel rendering portion 38, and the LCD I/F 26. The drawing control portion 42 receives the control signal according to the manipulation signal from the UI input portion 44 from the UI control portion 46 and then instructs the memory card I/F 22 to read the specified image, specifies a drawing size of the image with respect to the read image for the image resizing portion 34, instructs the sub-pixel rendering portion 38 to draw the image on the drawing buffer 24 by specifying the coordinate at which the image is to be drawn, instructs the UI object drawing portion 40 to draw the image, such as symbols and characters to be displayed on the LCD 12 along with the image according to the manipulation signal from the UI input portion 42, or instructs the LCD I/F 26 to transmit the data on the drawing buffer 24 to the LCD 12.

Figure 5:
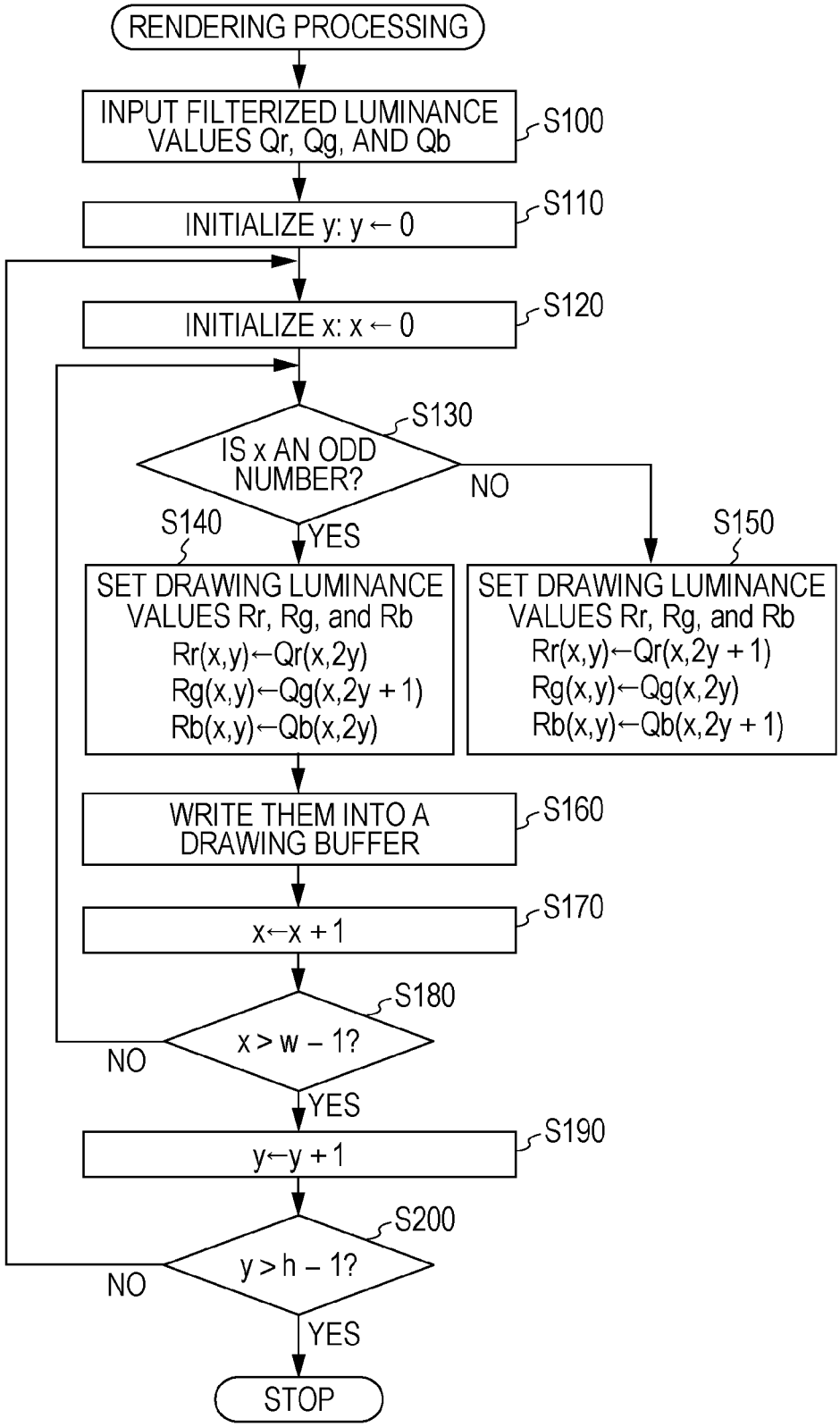
FIG. 5 is a flowchart illustrating an example of rendering processing.

Next, the operation of the image display control device 20 having the above structure according to this embodiment and in particular operation of the sub-pixel rendering portion 38 will be described. FIG. 5 is a flowchart illustrating an example of rendering processing performed by the sub-pixel rendering portion 38. This processing is performed when the drawing of the image is instructed by the drawing control portion 42.

Figure 6:
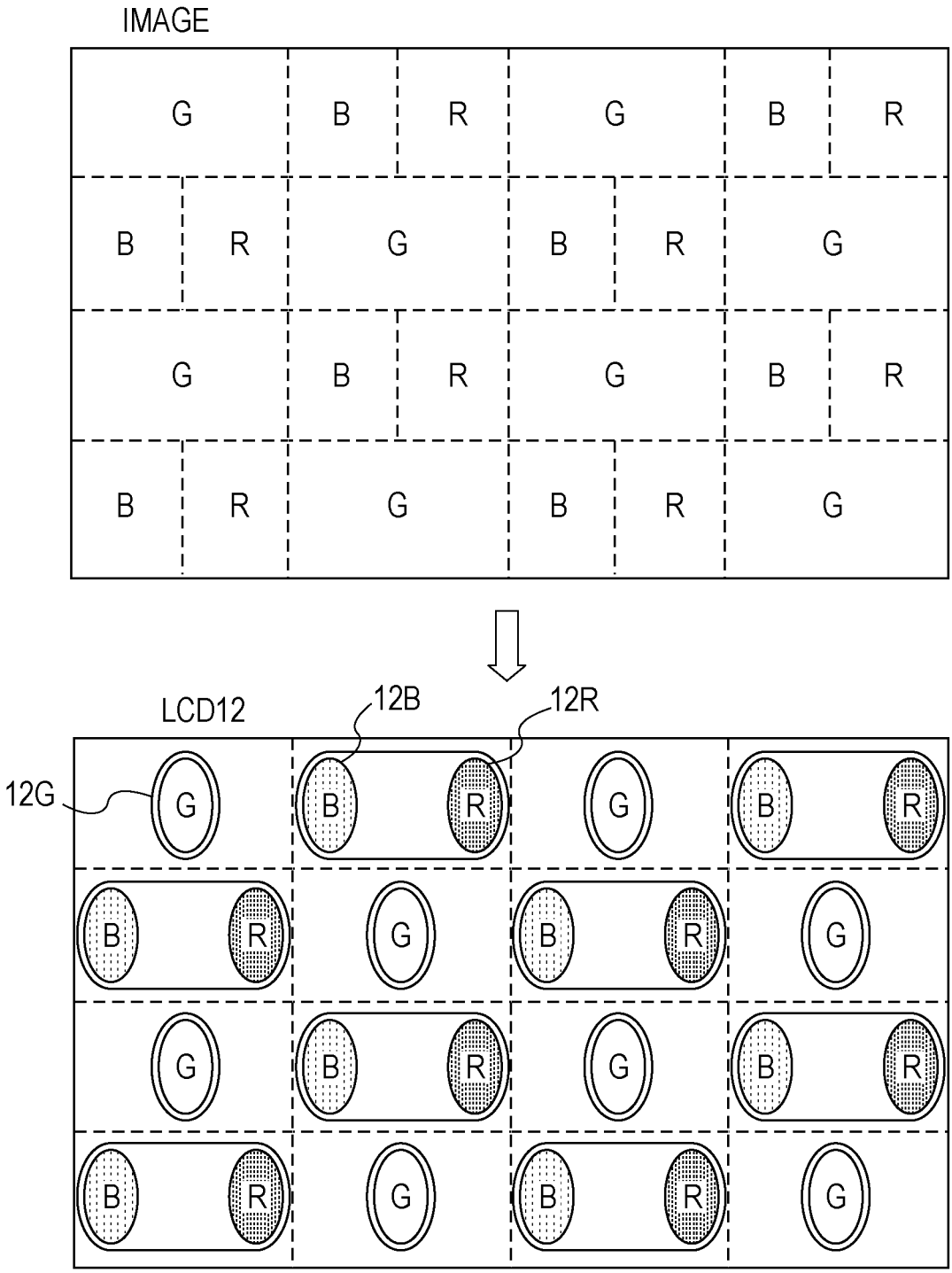
FIG. 6 is an explanatory view illustrating correspondence relationship between pixels of an image and dots of an LCD.
Figure 7:
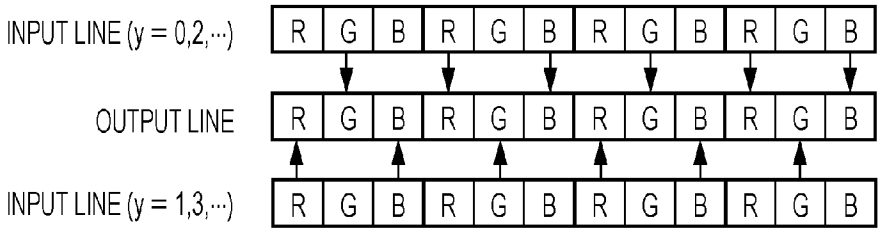
FIG. 7 is an explanatory view illustrating a state of rendering.

If the rendering processing is performed, the sub-pixel rendering portion 38 receives the filter-processed image data (luminance values Qr(x, y), Qg(x, y), and Qb(x, y) from the filtering portion 36 first of all (Step S100), initializes an index value y to 0 (Step S110), and initializes an index value x to 0 (Step S120). Subsequently, it is determined whether the index value x is a odd number (Step S130), drawing luminance values Rr(x, y), Rg(x, y), and Rb(x, y) for RGB, respectively, at the coordinate (x, y) are set using the following equations 4, 5, 6 when it is found that the index value x is an odd number (Step S140), drawing luminance values Rr(x, y), Rg(x, y), and Rb(x, y) for RGB, respectively, at the coordinate (x, y) are set using the following equations 7, 8, and 9 when it is found that the index value x is not an odd number, that is, the index value x is an even number (including 0) (Step S150), and the drawing luminance values Rr(x, y), Rg(x, y), and Rb(x, y) are written at the coordinate (x, y) in the drawing buffer 24 while considering the original point (0, 0) as the coordinate at which the drawing is specified by the drawing control portion 42 (Step S160). FIG. 6 is an explanatory view for explaining correspondence relationship between pixels of the image and dots 12R, 12G, and 12B of the LCD 12. FIG. 7 is an explanatory view illustrating a state of the image rendering. As shown in the drawing, processing of steps S130 to S150 is performed by setting drawing luminance values Rr(x, y), Rg(x, y), and Rb(x, y) such that one pixel of the image is constituted by two dots 12R and 12B while pairing a red (R) dot 12R and a blue (B) dot 12B among dots 12R, 12G, and 12B of the LCD 12 as one set and another pixel of the image is constituted by the remaining green (G) dot 12G Accordingly, as compared to the structure in which one pixel of the image is constituted by three dots 12R, 12G, and 12B of RGB in one set, the visual resolution is almost doubled. As shown in FIG. 6, the three dots 12R, 12Q and 12B are arranged in a delta form. However, when the dots 12R and 12B are in a pair, the pair of the dots 12R and 12B and the dot 12G are arranged in a lattice form. Accordingly, in the same manner, it can be simply matched with image data in which pixels are arranged in a lattice form. Therefore, it is possible to simplify the filter used in the filtering portion 36. Further, the structure in which only the green (G) dot 12G constitutes one pixel of the image while the dot 12R of red (R) and dot 12B of blue (B) constitute one pixel is configured based on the theory that green (G) among red (R), green (G), and blue (B) has the highest sensitivity of a human eye (spectral sensitivity) and thus such a structure can reduce the luminance difference between pixels.

$$Rr(x,y) \leftarrow Qr(x,2y) \quad 4;$$

$$Rg(x,y) \leftarrow Qg(x,2y+1) \quad 5;$$

$$Rb(x,y) \leftarrow Qb(x,2y) \quad 6;$$

$$Rr(x,y) \leftarrow Qr(x,2y+1) \quad 7;$$

$$Rg(x,y) \leftarrow Qg(x,2y) \quad 8;$$

$$Rb(x,y) \leftarrow Qb(x,2y+1) \quad 9;$$

Figure 8:
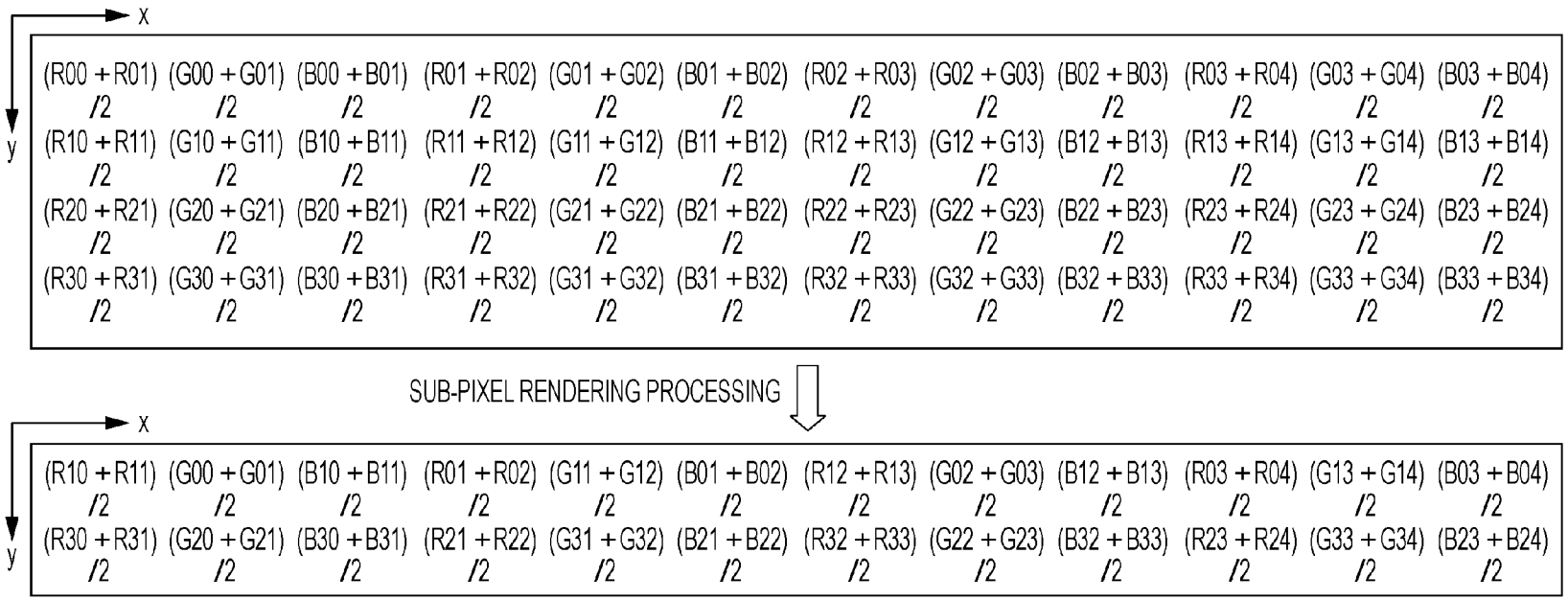
FIG. 8 is an explanatory view illustrating image data before rendering and after rendering, respectively.
Figure 9:
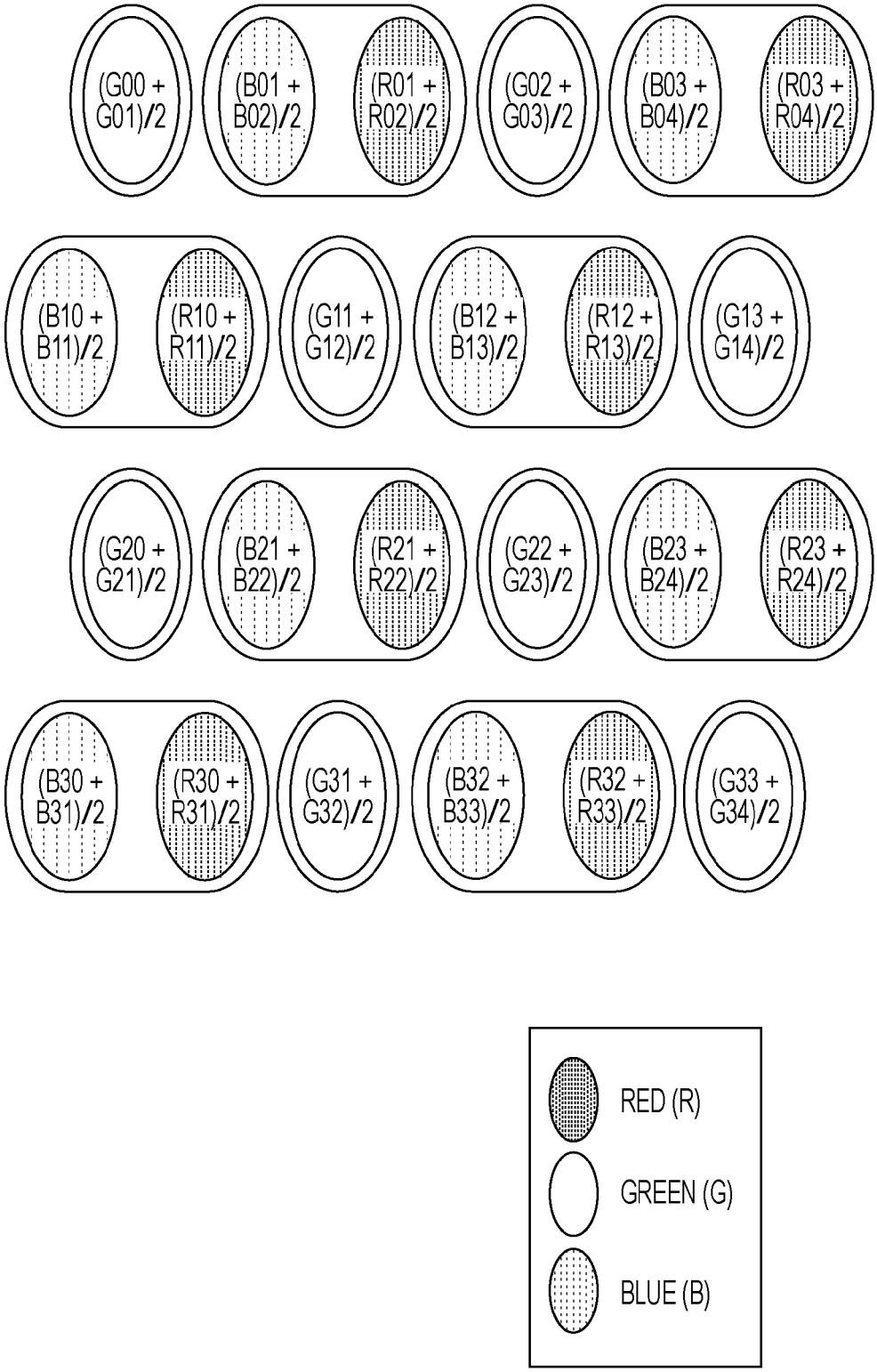
FIG. 9 is an explanatory view illustrating a state of display of the LCD 12.

If the writing of the drawing luminance values Rr(x, y), Rg(x, y), and Rb(x, y) of R, G, and B at the coordinate (x, y) is performed, the index value x is incremented by one (Step S170); it is determined whether the index value x is larger than a value obtained by decrementing one from the lateral size w of the resized image by the image resizing portion 34 (for example the value is 4 because the lateral size W is set to 5 in the embodiment) (Step S180); the processing returns to Step S130 to perform S130 to S180 again when the determination of Step S180 is negative; the index value y is incremented by one when the determination of Step S180 is positive (Step S190); it is determined whether the index value y is larger than a value obtained by decrementing one from the longitudinal size h of the resized image by the image resizing portion 34 (for example, the value is 3 because the longitudinal size h is 4 in this embodiment) (Step S200); the processing returns to Step S120 and steps S120 to S200 are performed again when the determination of Step S200 is negative; and the processing ends when the determination of Step S200 is positive. FIG. 8 shows the image data before the rendering processing and after the rendering processing. FIG. 9 shows an image displayed on the LCD 12 on the basis of the image data of FIG. 3.

Here, the correspondence relationship between elements of this embodiment and elements of the invention are clarified. The memory card I/F 22 of the embodiment corresponds to "image data input unit," and the image drawing portion 30 having the sub-pixel rendering portion 38 corresponds to "image drawing unit." In this embodiment, an example of an image display control method of the invention will be cleared by explaining operation of the image display control device 20.

According to the image display control device 20 of the above described embodiment, since the image input via the memory card I/F 22 is drawn such that two dots, the dot 12R of red (R) and the dot 12B of blue (B), among the dots 12R, 12G, and 12B corresponding to signals of R, G, and B of the LCD 12 are in one pair, and one pixel of the image is constituted by the pair of two dots 12R and 12B and another pixel of the image is constituted by only the dot of Green (G), it is possible to improve the display quality in comparison with the structure in which three dots of R, G, and B are in one set so that one pixel of the image is constituted by the three dots. Further, it is possible to decrease the size of the image data used in the rendering processing in comparison with the structure in which each of three dots of R, G, and B constitutes one pixel, which results in reduction in necessary memory capacity and processing load. Still further, since a pair of the dot 12R of red (R) and the dot 12B of blue (B) among R, G, and B constitute one pixel, and only the dot 12G of green (G)

which has the highest spectral sensitivity constitutes one pixel, it is possible to reduce the luminance difference between pixels and further to improve the display quality. Further, since pixels are structured such that pairs of the dots 12R and 12B and the dots 12G are arranged in a lattice form, this can be matched with the image data in which every pixel is arranged in the lattice form in a simple manner, the filter used in the filtering portion 36 can be simple, and operation load can be reduced. Most of all, it is possible to improve the brightness by reducing the number of dots and raising the aperture ratio in comparison with the stripe-arrangement display device having the same visual resolution.

In this embodiment, the filter processing of the filtering portion 36 is performed by taking the average value of the luminance values of two pixels adjacent to each other in the horizontal (lateral) direction, but it is not limited thereto. For example, the luminance values can be averaged using the known filter of 3×3 pixels. That is, any other filtering methods can be used.

Figure 10:
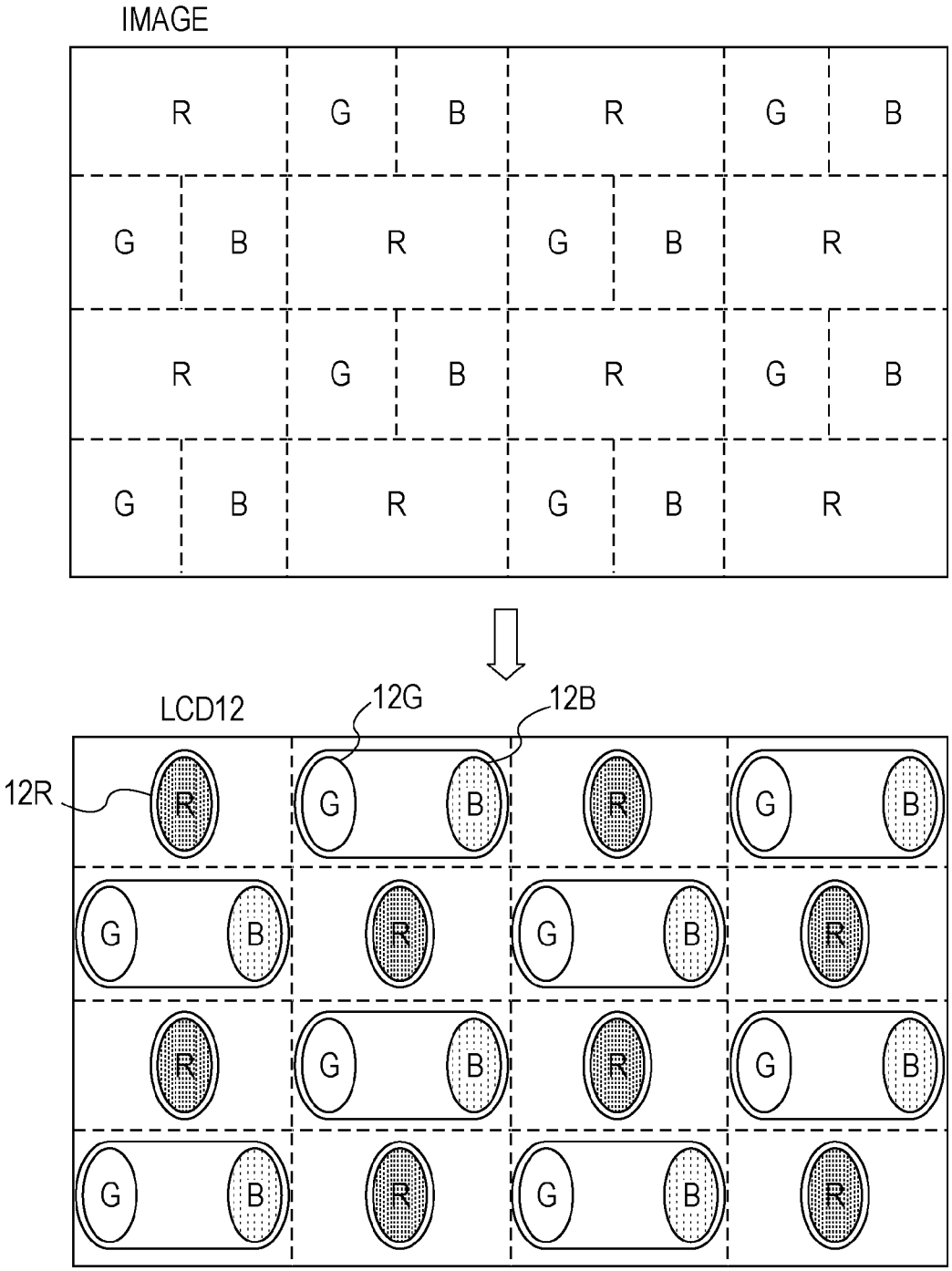
FIG. 10 is an explanatory view illustrating correspondence relationship between pixels of an image and dots of an LCD according to one modification.

In this embodiment, as shown in FIG. 6, the image is drawn such that the dot 12R of red (R) and the dot 12B of blue (B) among the dots 12R, 12G, and 12B corresponding to signals of R, G, and B are in one pair, one pixel of the image is constituted by the two dots 12R and 12B, and another pixel of the image is constituted by only one dot of green (G). However, as shown in FIG. 10, the image can be drawn such that two dots 12G and 12B are in one pair so as to constitute one pixel of the image by the dot 12G of green (G) and the dot 12B of blue (B) and only the dot 12R of red (R) constitutes one pixel. This structure is based on the theory such that since blue (B) among R, G, and B has the lowest spectral sensitivity, the structure in which the dot 12B of blue (B) is combined with the dot 12R of red (R) as in the embodiment to constitute one pixel or the dot 12B of blue (B) is combined with the dot 12G of green (G) to constitute one pixel can perform higher definition display in comparison with the structure in which only the dot 12B of blue (B) constitutes one pixel alone. Further, even though the display quality is somewhat inferior to the structure of the embodiment for such a reason, the image may be drawn with the structure in which the dot 12R of red (R) and the dot 12G of green (G) are in one pair so that the two dots 12R and 12G constitutes one pixel of the image and only the dot 12B of blue (B) constitutes one pixel of the image.

In this embodiment, the liquid crystal display (LCD) 12 is used as a display device but the display device in the invention is not limited thereto. That is, the display device may be any type of display device, such as a plasma display panel or an organic electroluminescence panel, as long as three dots corresponding to signals of three primary colors are arranged in a delta form.

Hereinabove, the embodiment of the invention is described but the invention is not limited thereto. The invention can be implemented into various kinds of forms as long as they are within the technical scope of the invention.

What is claimed is:

1. An image display control device for controlling display of an image comprising:

a display device having a plurality of unit display elements, wherein in the unit display element a set of three unit display elements correspond to signals of three primary colors respectively;

an image data input unit which inputs image data; and an image drawing unit which draws an image on the display device based on the input image data such that two of the three unit display elements are in a pair of sub-pixels and constitute one pixel of the image having a plurality of pixels and the remaining one unit display element constitutes another pixel in the plurality of pixels of the image, wherein each set of three unit display elements is arranged in a delta form, wherein the plurality of unit display elements are arranged in a lattice form by alternating the delta form of each set of three unit display elements.

2. The image display control device according to claim 1, wherein the two of three unit display elements are red (R) and blue (B) unit display elements and the remaining one unit display element is a green (G) unit display element.

3. The image display control device according to claim 1, wherein the image drawing unit is a unit for performing drawing on processed image data obtained by subjecting the input image data to filter processing.

4. An image display control method of controlling display of an image comprising:

inputting image data; and drawing an image on a display device, the display device having a plurality of unit display elements, wherein the unit display element, in which a set of three unit display elements correspond to a signals of three primary colors respectively, wherein the drawing is based on the input image data such that two of the three unit display elements are in a pair of sub-pixels and constitute one pixel of the image having a plurality of pixels and the remaining one unit display element constitutes another pixel in the plurality of pixels of the image, wherein each set of three unit display elements is arranged in a delta form, wherein the plurality of unit display elements are arranged in a lattice form by alternating the delta form of each set of three unit display elements.

* * * * *